US011213111B1

(12) United States Patent
Hott et al.

(10) Patent No.: US 11,213,111 B1
(45) Date of Patent: Jan. 4, 2022

(54) BALL CONVEYANCE ACCESSORY

(71) Applicants: Susan Hott, Riverside, CA (US); Madeleine Hott, Riverside, CA (US)

(72) Inventors: Susan Hott, Riverside, CA (US); Madeleine Hott, Riverside, CA (US)

( * ) Notice: Subject to any disclaimer, the term of this patent is extended or adjusted under 35 U.S.C. 154(b) by 0 days.

(21) Appl. No.: 16/862,259

(22) Filed: Apr. 29, 2020

Related U.S. Application Data

(60) Provisional application No. 62/959,121, filed on Jan. 9, 2020.

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45F 3/04; A45F 2003/003; A45F 3/047
See application file for complete search history.

(56) References Cited

U.S. PATENT DOCUMENTS 4,988,216 A * 1/1991 Lyman ..... A45C 11/20 383/110
5,135,222 A * 8/1992 Spector ..... A63B 41/02 150/106
D335,956 S * 6/1993 Lucas ..... D3/238
6,029,877 A * 2/2000 Woods ..... A45C 13/02 224/236
6,095,390 A * 8/2000 Bogle ..... A45F 3/00 206/315.9
D440,040 S 4/2001 Cantasano
6,892,916 B1 5/2005 Rugg
7,160,028 B1 * 1/2007 Linday ..... A45C 9/00 150/108
7,600,620 B2 10/2009 Hammond
9,119,448 B1 9/2015 Hirshberg
D771,378 S 11/2016 Burrington
2003/0218039 A1 * 11/2003 Abel ..... A45C 13/04 224/656
2006/0226038 A1 10/2006 Lampley
2006/0289588 A1 * 12/2006 Lindberg ..... A45C 7/0077 224/629
2007/0095868 A1 * 5/2007 Martin ..... A45F 3/04 224/153
2010/0219222 A1 * 9/2010 Winneur ..... A45C 9/00 224/629

(Continued)

FOREIGN PATENT DOCUMENTS

CA 2362616 11/2001

*Primary Examiner* — Brian D Nash
(74) *Attorney, Agent, or Firm* — Knobbe, Martens, Olson & Bear, LLP

(57) ABSTRACT

Various bag attachment assemblies are disclosed. The bag attachment assembly can include a panel, a cord lock, a plurality of upper straps, and a plurality of lower straps. The panel can comprise a center portion that can comprise an elastic material and a perimeter portion having a channel with an elastic cord. The cord lock can be connected to the elastic cord and can be configured to cinch the perimeter portion when actuated. The plurality of upper straps and the plurality of lower straps can be configured to secure the panel to the bag and to be tightened to apply compressive force between the panel and the bag.

15 Claims, 10 Drawing Sheets

(56) References Cited

U.S. PATENT DOCUMENTS

| | | | | |
|---|---|---|---|---|
| 2010/0284631 | A1* | 11/2010 | Lee | A45C 3/06<br>383/12 |
| 2018/0154203 | A1* | 6/2018 | Schromm | A45F 3/04 |
| 2018/0255893 | A1* | 9/2018 | Godshaw | A45C 3/06 |
| 2018/0303211 | A1* | 10/2018 | Nowak | A45C 3/00 |
| 2019/0387865 | A1* | 12/2019 | Panza, III | A45C 13/001 |
| 2020/0077820 | A1* | 3/2020 | Lowry | A47C 27/081 |
| 2020/0087035 | A1* | 3/2020 | Reinsfelder | A44B 17/0041 |
| 2020/0128943 | A1* | 4/2020 | D'Alessandro | A45F 3/047 |

* cited by examiner

BALL CONVEYANCE ACCESSORY

CROSS REFERENCE

This application claims the benefit of U.S. Provisional Application No. 62/959,121, filed Jan. 9, 2020, the entirety of which is hereby incorporated by reference.

BACKGROUND

Field

The present disclosure generally relates to bag accessories that attach to a bag (e.g., a backpack) in order to carry a bulky accessory outside the bag. For example, the bag accessory can enable a user to carry one or more balls, such as a basketball or other sports balls, outside their backpack so that the user can store other items within the bag.

Description of Certain Related Art

Many people use bags (e.g., backpack or gym bag) in a wide variety of activities in their everyday life, from carrying books and other school-related materials to carrying their gym clothes. Likewise, many people want to transport sporting goods, such as balls. In some situations, people want to carry both a sporting good and other articles. For example, a student may want to transport a basketball and textbooks to school.

SUMMARY OF CERTAIN FEATURES

Bags, such as backpacks, have a limited internal space. Balls, such as basketballs and volleyballs, are large compared to the available space of many bags. In some cases, the ball will not fit inside the bag at all. Even in those cases in which the ball fits within the bag, the ball occupies a large percentage of the available space. This leave little space for other articles, such as books, computers, notebooks, folders, etc. Some balls, such as baseballs or softballs, are hard, which can cause damage to other items in the bag, such as laptop computers.

Rather than being positioned in the bag, the ball could be carried in the arms of the bag's user (e.g., the wearer of the backpack). However, this can be inconvenient, tiring, and/or cumbersome, as it places the weight and bulk of the ball on the user's arm or arms. Also, having the user hold the ball inhibits or prevents the user from doing other tasks and/or can be disallowed in certain circumstances. Further, this can increase the risk of the ball becoming separated from the user, such as by the user accidentally losing control of and/or dropping the ball and the ball rolling away.

It would be beneficial to be able to securely carry a ball (e.g., a basketball) or other bulky object, on, but outside of, the bag. This would preserve space inside the bag for other articles. It would also be convenient and would free-up the user's hand to accomplish other tasks. Also, this would place the weight of the ball in a location adapted to bear the weight (e.g., the user's back through the backpack straps). Further, this would reduce the risk of the ball becoming accidentally loose and/or would place the ball in a position to reduce or avoid the ball from damaging other items in the bag, such as a laptop computer.

Additionally, it would be beneficial for the ball to be held securely relative to the bag and/or the user. This can inhibit or prevent the ball from rocking or swaying as the user walks or runs, which would be uncomfortable and could increase the risk of the ball becoming free.

Further, it would be beneficial for the ball to be contained in an accessory that is separable from and/or not permanently joined to the bag (e.g., backpack). This can allow the user the option to carry the bag alone, the accessory alone, or the bag and accessory combination. For example, the removable accessory can enable a user to wear the bag with the bag connected for a first period (e.g., during travel to an event, such as practice or a game), remove the accessory from the bag for a second period (e.g., after having arrived at the event), and reconnect the accessory to the bag for a third period (e.g., during travel from the event). Additionally, when the user changes bags, being removable can allow the accessory to be moved to the new bag.

The ball conveyance accessories disclosed herein address one or more of the above concerns, or other concerns.

In some aspects of the disclosure, a bag attachment assembly configured to removably connect to a backpack and to carry one or more balls outside of the backpack is disclosed. The bag attachment assembly may comprise a panel, a cord lock, a plurality of upper straps, and a plurality of lower straps. The panel may be configured to at least partially surround a space configured to receive the one or more balls. The panel may comprise a center portion comprising an elastic material, and a perimeter portion bounding at least a portion of the center portion. The perimeter portion may have a channel with an elastic cord. The elastic cord may be configured to be pulled at least partly out of the channel. The cord lock may be connected to the elastic cord. The cord lock may be configured to secure the elastic cord in a position relative to the channel. The plurality of upper straps may be configured to secure the panel to an upper portion of the backpack. Each of the plurality of upper straps may comprise an upper adjustment mechanism and an upper connector. The upper adjustment mechanism may be configured to adjust a length of the respective upper strap and the upper connector may be configured to connect the respective upper strap to the upper portion of the backpack. The plurality of lower straps may be configured to secure the panel to a lower portion of the backpack. Each of the plurality of lower straps may comprise a lower adjustment mechanism and a lower connector. The lower adjustment mechanism may be configured to adjust a length of the respective lower strap and the lower connector may be configured to connect the respective lower strap to the lower portion of the backpack. The bag attachment assembly may be configured such that, in response to the elastic cord being pulled partially out of the channel, the panel cinches around the one or more balls and applies a compressive force on the one or more balls against the backpack.

The bag attachment assembly of the preceding paragraph can also include one or more of the following features. The upper adjustment mechanism can comprise a squeeze clip and the upper connector can comprise a hook and loop fastener. The lower adjustment mechanism can comprise a squeeze clip and the lower connector can comprise a male and female snap assembly. A height of the panel can be approximately 24 inches and a width of the panel can be approximately 18 inches. The plurality of upper straps and the plurality of lower straps can be configured to adjust the bag attachment assembly without removing the bag attachment assembly via the upper connector and/or the lower connector. The cord lock can be configured to allow the user to loosen the perimeter portion such that the user is able to access the one or more balls stored between the bag attachment assembly and the backpack without removing the bag attachment assembly from the backpack.

In some aspects, a bag attachment assembly configured to removably connect to a bag and to carry one or more objects outside of the bag is disclosed. The bag attachment assembly may comprise a body, a top portion, a bottom portion, and a fastener. The body may comprise an interior side, an exterior side, and a perimeter portion. The interior side may be configured to contact the one or more objects in use. The exterior side may be configured to face away from the one or more objects in use. The perimeter portion may comprise an internal portion and an external portion. The internal portion may comprise an internal passageway with an elastic cord. The external portion may comprise an opening at a top of the perimeter portion. An external portion of the elastic cord may pass through the opening. The top portion may be connected with the body. The top portion may comprise an upper elongate strap and an upper attachment mechanism. The upper elongate strap may be configured to attach the bag attachment assembly to the bag. The upper elongate strap may comprise a first portion and a second portion. The first portion may comprise a first element of a hook and loop fastener and the second portion may comprise a second element of the hook and loop fastener. The upper attachment mechanism may be configured to attach the top of the perimeter portion to the upper elongate strap. The bottom portion may be connected with the body. The bottom portion may comprise a bottom elongate strap and a bottom attachment mechanism. A first portion of the bottom elongate strap may comprise an element of a mating fastener and a second portion of the bottom elongate strap may comprise a corresponding element of the mating fastener. The bottom attachment mechanism may be configured to attach a portion of a bottom of the perimeter portion to the bottom elongate strap. The fastener may be configured to engage with the external portion of the elastic cord of the body. The bag attachment assembly may be configured such that actuating the fastener allows a user to pull the external portion of the elastic cord and thereby tighten the perimeter portion around the one or more objects.

The bag attachment assembly of the preceding paragraph can also include one or more of the following features. The bag can comprise a backpack. The bag can comprise a duffel bag. The upper attachment mechanism can comprise a first upper squeeze clip and a second upper squeeze clip. The upper elongate strap and the bottom elongate strap can comprise nylon material. The upper attachment mechanism and the bottom attachment mechanism can be configured to adjust the bag attachment assembly without removing the hook and loop fastener or the mating fastener. The fastener can be configured to allow the user to loosen the perimeter portion such that the user is able to access the one or more objects stored between the bag attachment assembly and the bag without removing the bag attachment assembly from the bag. The one or more objects can comprise a basketball. The mating fastener can comprise a snap fastener.

For purposes of summarizing the disclosure, certain aspects, advantages, and features of the technology have been described herein. Not necessarily any or all such advantages are achieved in accordance with any particular embodiment of the technology disclosed herein. No aspects of this disclosure are essential or indispensable. Neither the preceding summary nor the following detailed description purports to limit or define the scope of protection. The scope of protection is defined by the claims.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments.

DETAILED DESCRIPTION OF CERTAIN EMBODIMENTS

Figure 1:
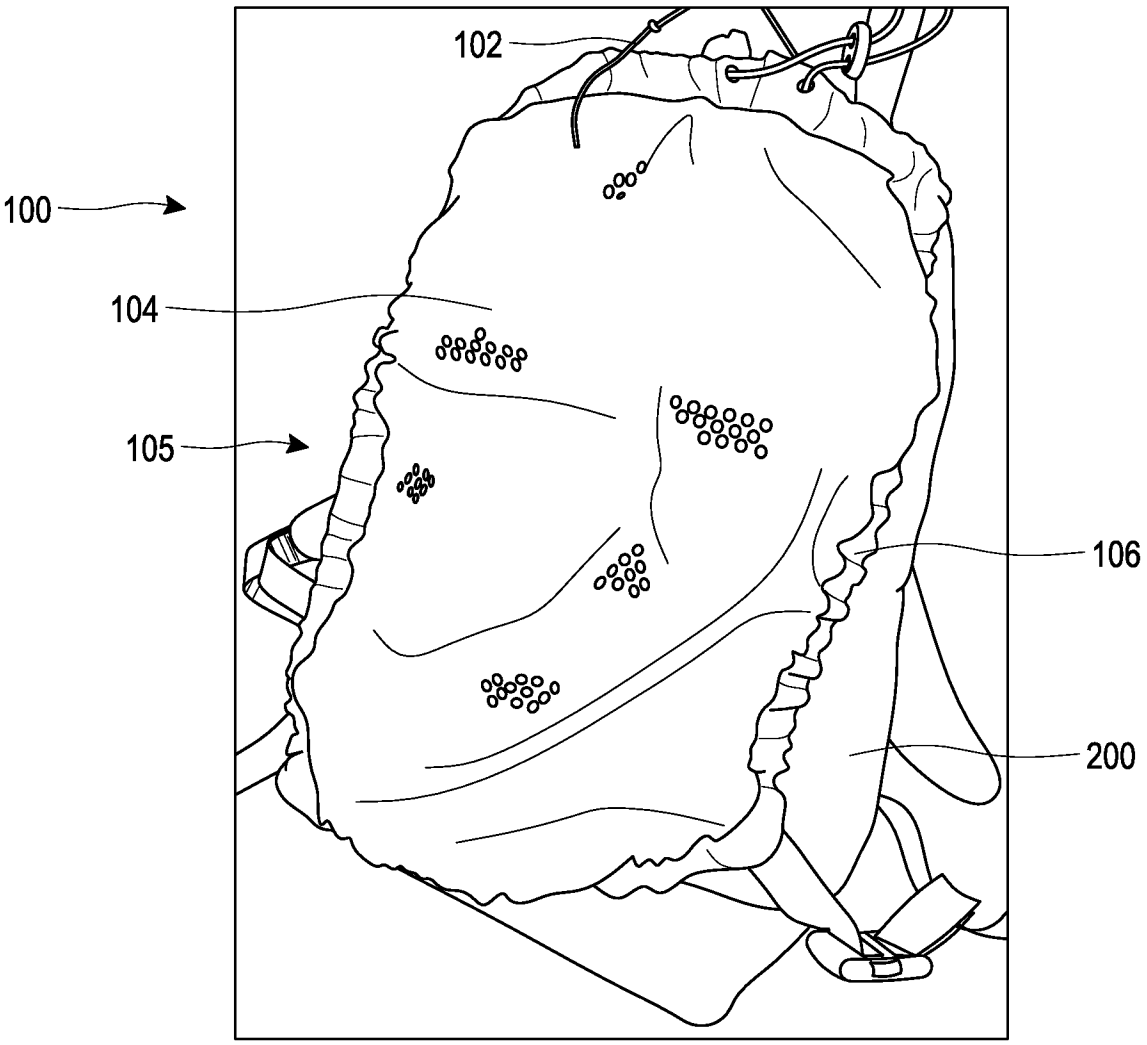
FIG. 1 shows a perspective view of an embodiment of a bag attachment accessory attached to a backpack.

Reference will now be made in detail to various embodiments of the present technology, which relates to a bag attachment assembly. Although certain specific embodiments of the present technology are described, the present technology is not limited to these embodiments. On the contrary, these described embodiments are merely illustrative of the present technology, and the present technology is intended to also cover alternatives, modifications, and equivalents. Furthermore, in the following detailed description, numerous specific details are set forth in order to provide a thorough understanding of the present technology. However, it will be recognized by one of ordinary skill in the art that embodiments can be practiced without these specific details. In some instances, well known methods, procedures, compounds, compositions and mechanisms have not been described in detail as not to unnecessarily obscure aspects of embodiments of the present technology.

FIGS. 1-10 illustrate an embodiment of a bag attachment accessory 100. As shown in FIGS. 1-10, the bag attachment accessory 100 can include a panel 105 (also called a body), a top portion 108, and a bottom portion 118. The panel 105 can comprise a center portion 104 and a perimeter portion 106. The perimeter portion 106 can have a channel with a cinching element, such as an elastic cord 102. The cinching element can be connected to a fastener 116. The top portion 108 can comprise at least one upper attachment mechanism 110*a*, 110*b* and/or a plurality of upper straps 112*a*, 112*b*. The bottom portion 118 can comprise at least one lower attachment mechanism 120*a*, 120*b* and/or a plurality of lower straps 122*a*, 122*b*.

Figure 3:
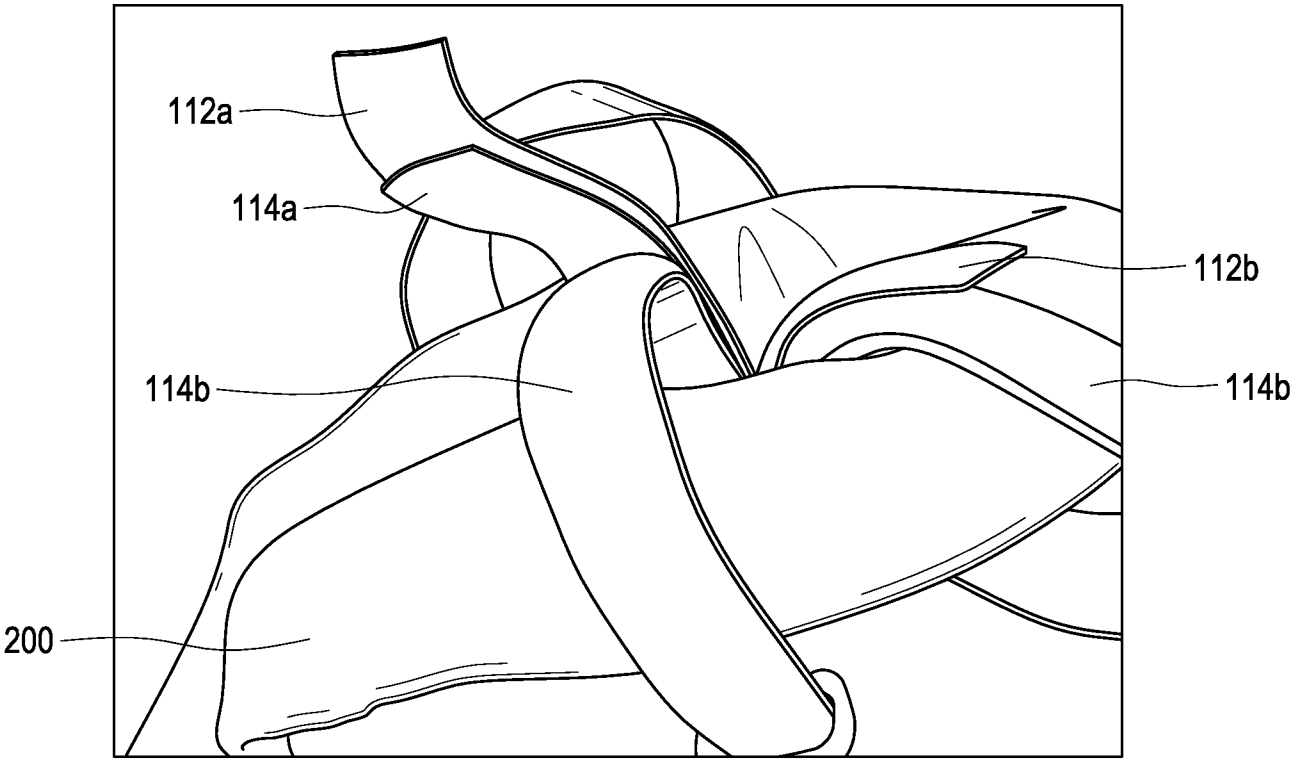
FIG. 3 shows a close up of upper straps of the bag attachment accessory of FIG. 1 attached to an upper portion of the backpack.

As shown in FIG. 3, the plurality of upper straps 112*a*, 112*b* can include a first upper strap 112*a* and a second upper strap 112*b*. The straps 112*a*, 112*b* can comprise a flexible material, such as nylon. In some embodiments, the straps 112*a*, 112*b* include a securing mechanism, such as a hook and loop fastener 114*a*, 114*b* (e.g., Velcro®). A portion of each of the upper straps 112*a*, 112*b* can include one element 114*a* of the hook and loop fastener and another portion of each of the upper straps 112*a*, 112*b* can include the corresponding element 114*b* of the hook and loop fastener.

In the embodiment shown in FIG. 3, the upper straps 112*a*, 112*b* can be configured to connect to (e.g., wrap around) a top handle of the backpack 200 to secure the panel 105 to the backpack 200. The hook and loop fastener 114*a*, 114*b* allow for the upper straps 112*a*, 112*b* to be adjustable such that the user can adjust how tightly or loosely the upper straps 112*a*, 112*b* are wrapped around the top handle or other parts of the backpack 200. In use, the upper straps 112*a*, 112*b* can apply a compressive force between the panel 105 and the backpack 200 such that the ball or other object is secured between the panel 105 and the backpack 200.

The bag attachment assembly 100 can also be used with other bags besides a backpack 200. For example, the bag attachment assembly 100 can be used with a variety of athletic bags and duffel bags. In some embodiments, the upper straps 112*a*, 112*b* can include any suitable securing mechanism that allows a user to adjustably secure the upper straps 112*a*, 112*b* to a suitable bag (e.g., a backpack 200 or a duffel bag). For example, one or each upper strap 112*a*, 112*b* can comprise a protruding element of a button enclosure on a part of the upper strap 112*a*, 112*b* and a plurality of receiving elements of a button enclosure on the other part of the upper strap 112*a*, 112*b* such that the user can adjustably secure the upper straps 112*a*, 112*b* to the bag by using different receiving elements. In some variants, one or each upper strap 112*a*, 112*b* can comprise a plurality of protruding elements of a button enclosure and a receiving element of a button enclosure to adjustably secure the upper straps 112*a*, 112*b* to the bag by using different protruding elements.

Figure 4:
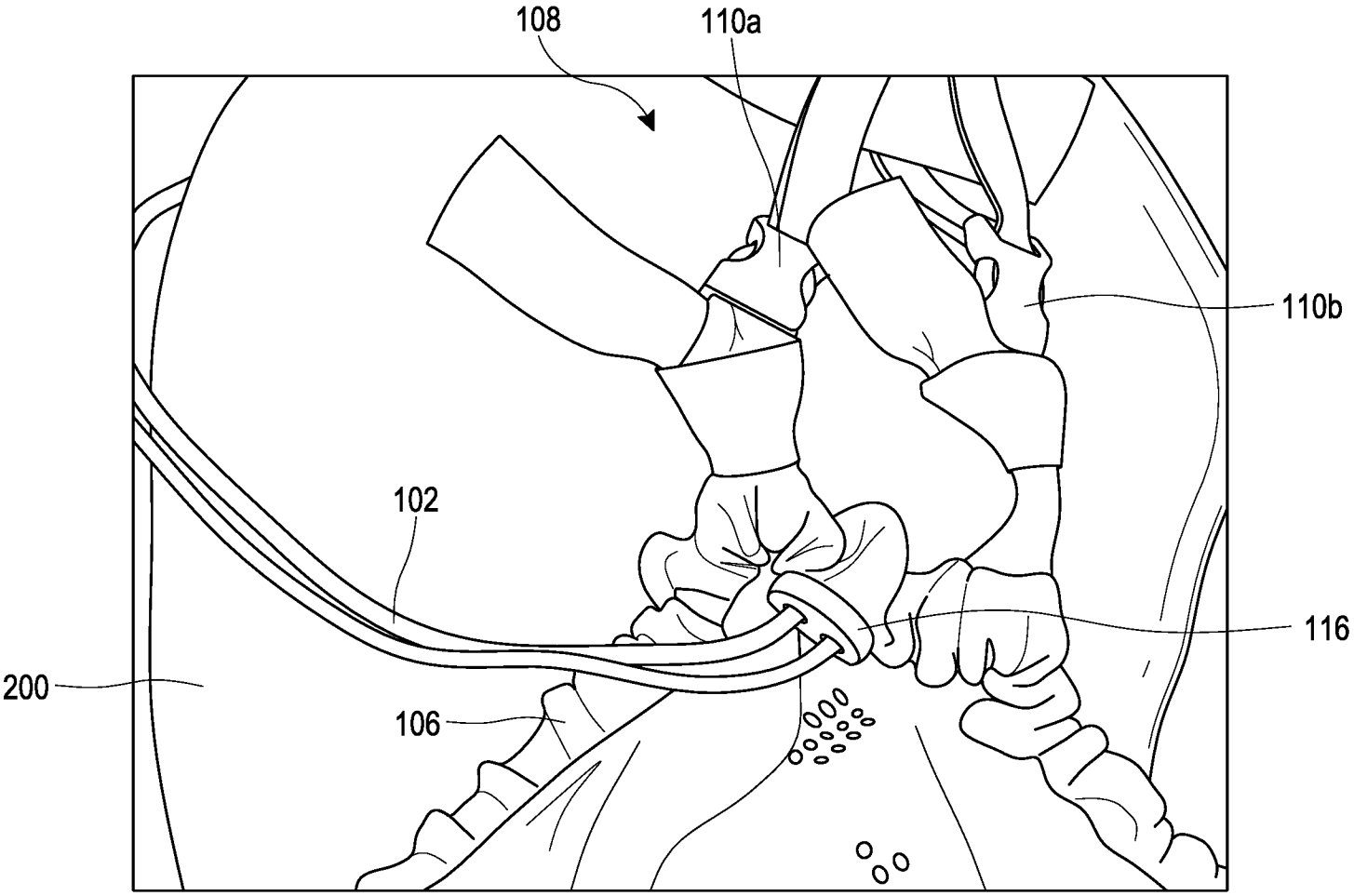
FIGS. 4-6 show different views of the top portion of the bag attachment accessory of FIG. 1.
Figure 5:
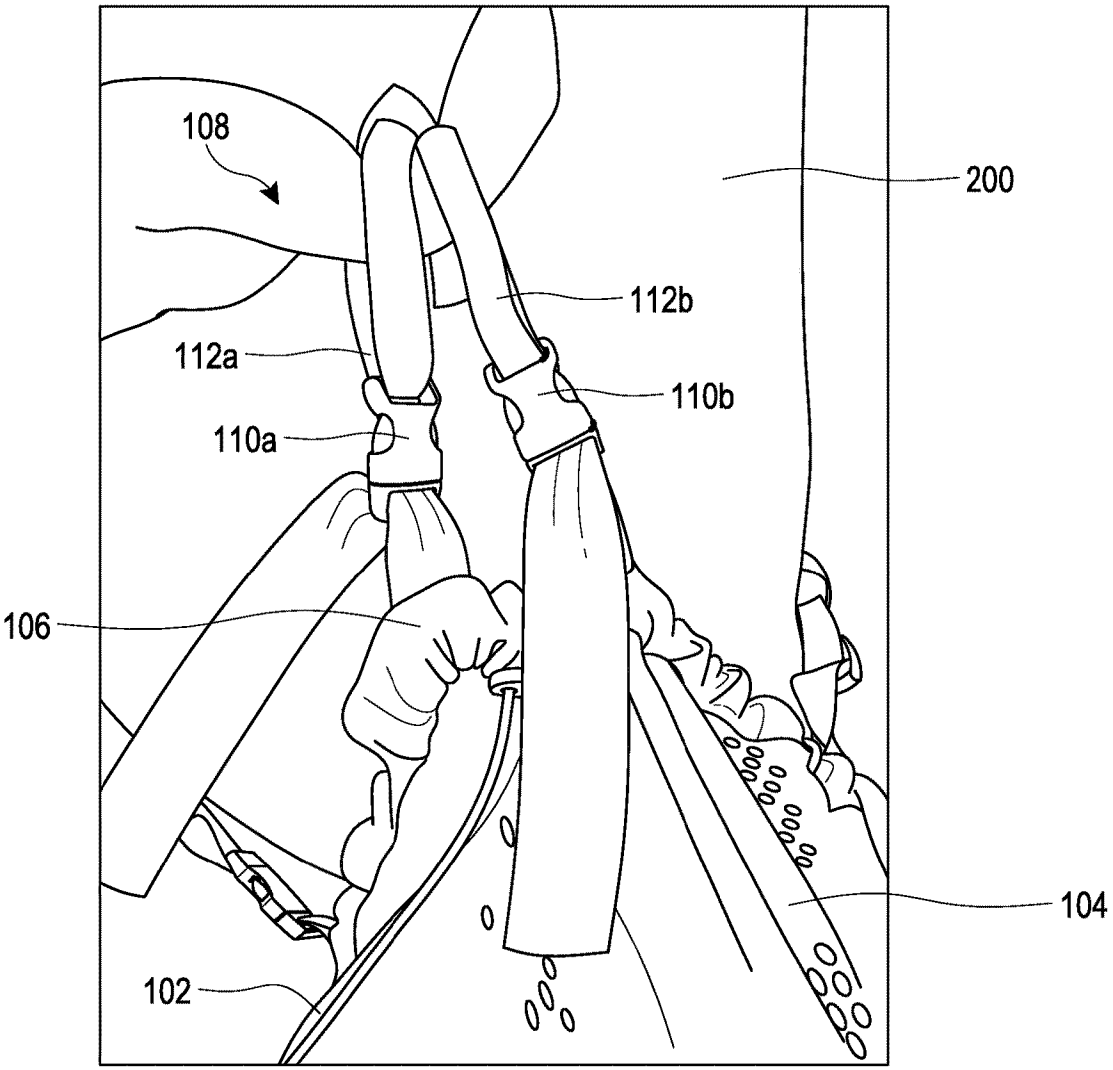

As shown in FIGS. 4-5 and as described above, the top portion 108 of the bag attachment assembly 100 can comprise at least one upper attachment mechanism. The at least one upper attachment mechanism can include a first upper connector and a second upper connector. In some embodiments, the first upper connector comprises a first upper squeeze clip 110*a* and/or the second connector comprises a second upper squeeze clip 110*b*. The upper squeeze clips 110*a*, 110*b* can also be referred to as upper side release buckles. The upper squeeze clips 110*a*, 110*b* can be configured to attach a top portion of the panel 105 to the upper straps 112*a*, 112*b*. For example, in some aspects, the upper squeeze clips 110*a*, 110*b* can each comprise a male element and a female element. The female elements of the upper squeeze clips 110*a*, 110*b* can be configured to receive the male elements of the upper squeeze clips 110*a*, 110*b*. The male elements may be attached to one of the plurality of upper straps 112*a*, 112*b* or the top portion of the panel 105. The female elements may be attached to the other of the plurality of upper straps 112*a*, 112*b* or the top portion of the panel 105. Therefore, the top portion of the panel 105 may be attached to the upper straps 112*a*, 112*b* by inserting the male elements into the female elements.

Figure 2:
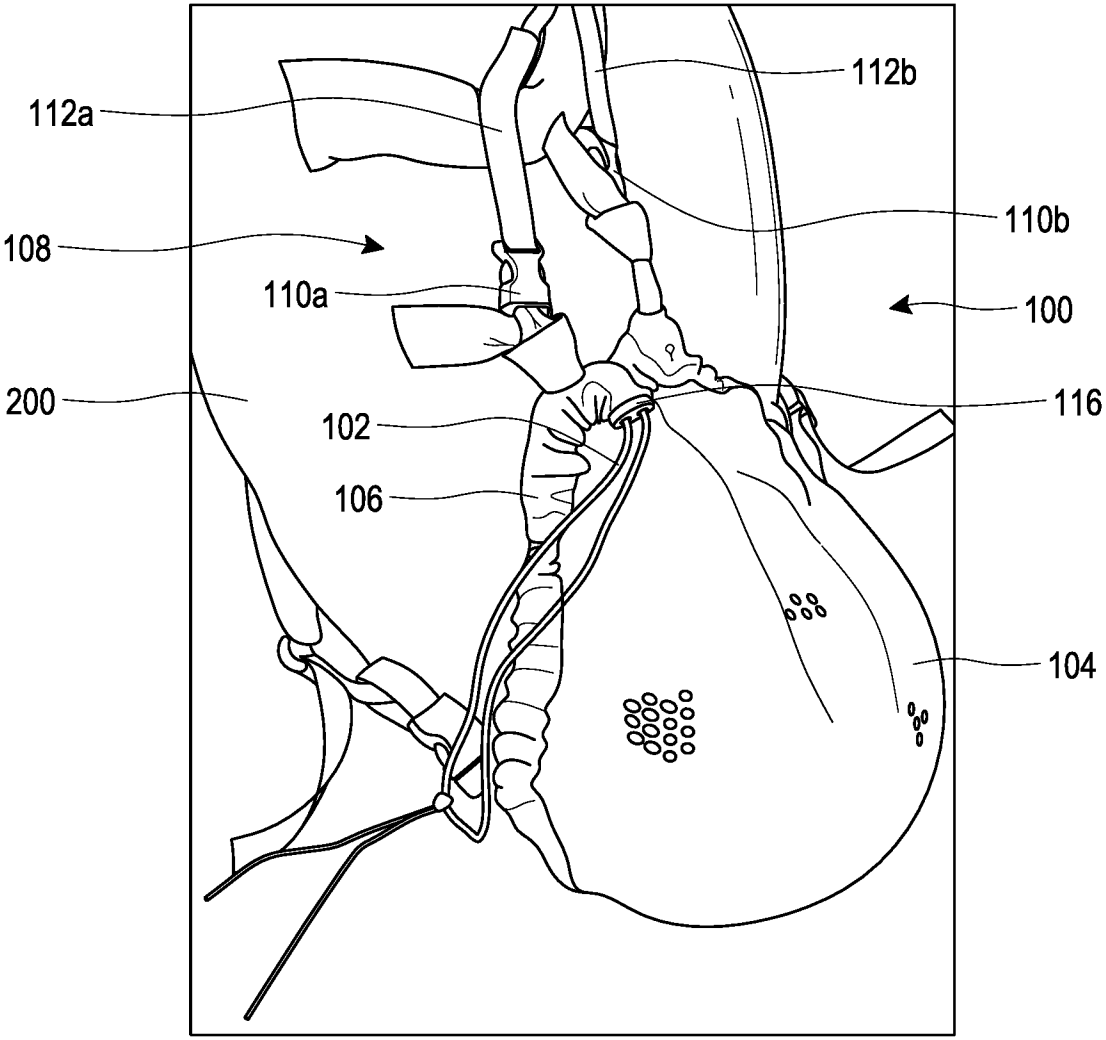
FIG. 2 shows a top perspective view of the bag attachment accessory of FIG. 1 retaining a ball and attached to the backpack.
Figure 6:
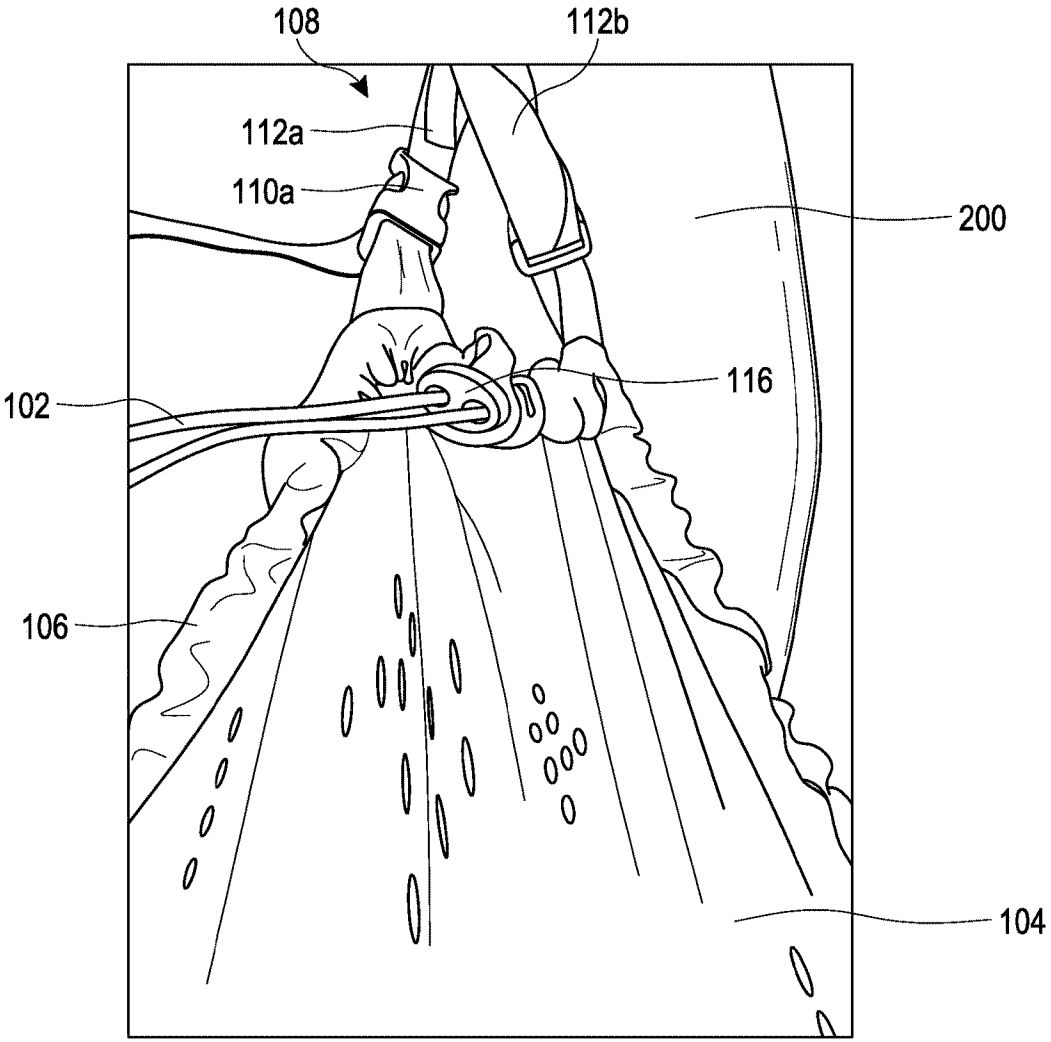
Figure 7:
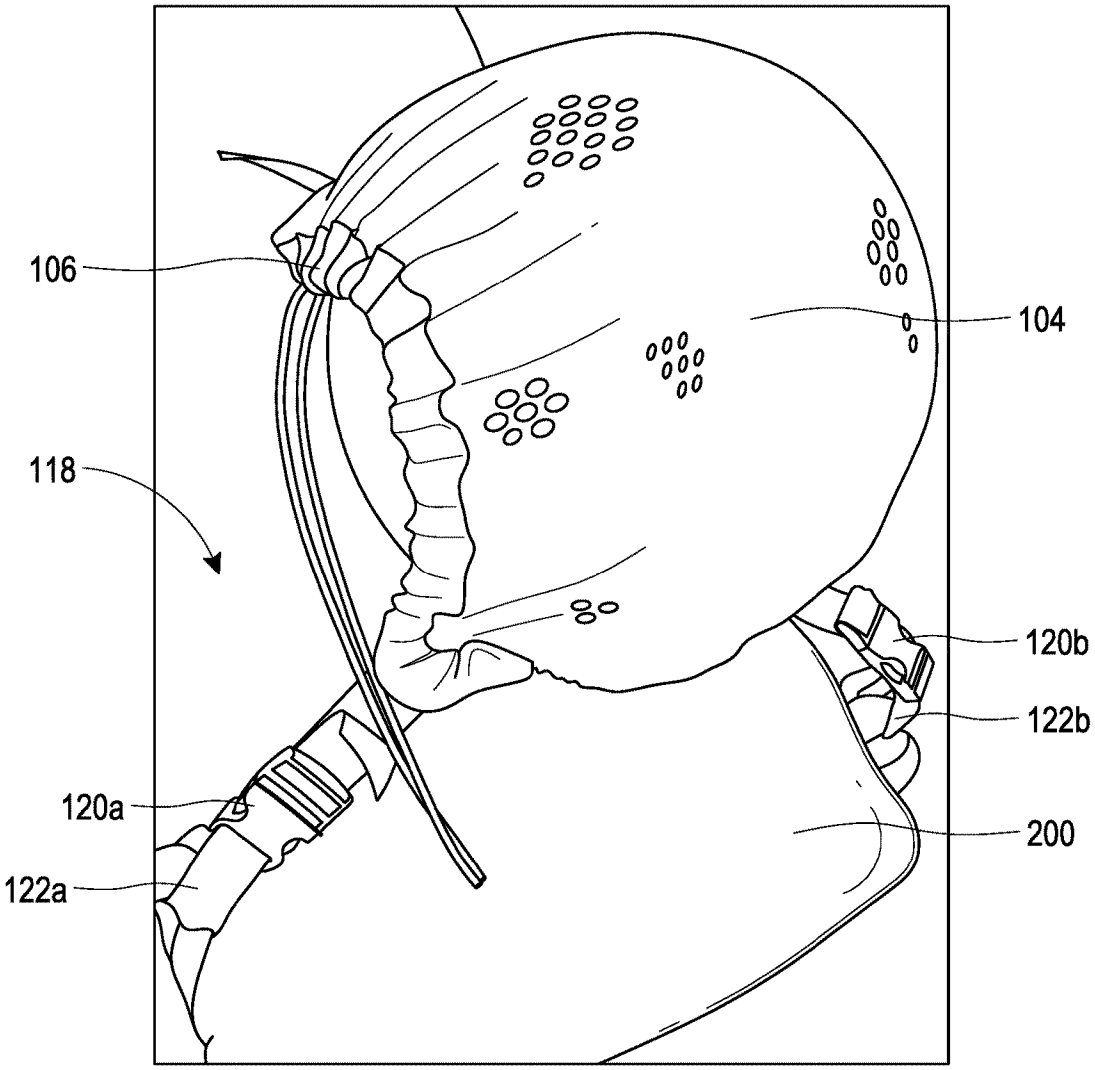
FIGS. 7-10 show various views of the bottom portion of the bag attachment accessory of FIG. 1 retaining a ball and attached to the backpack.
Figure 8:
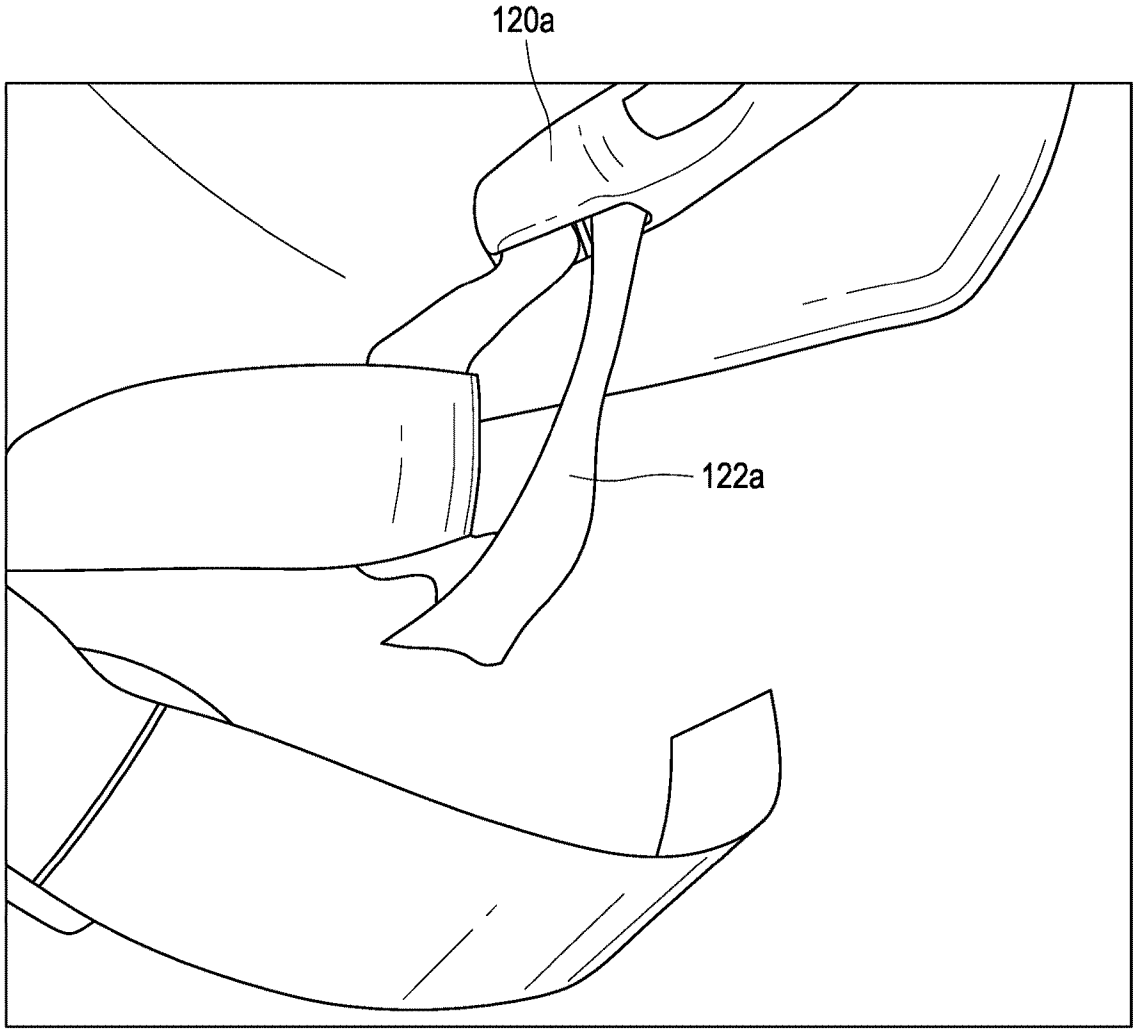
Figure 9:
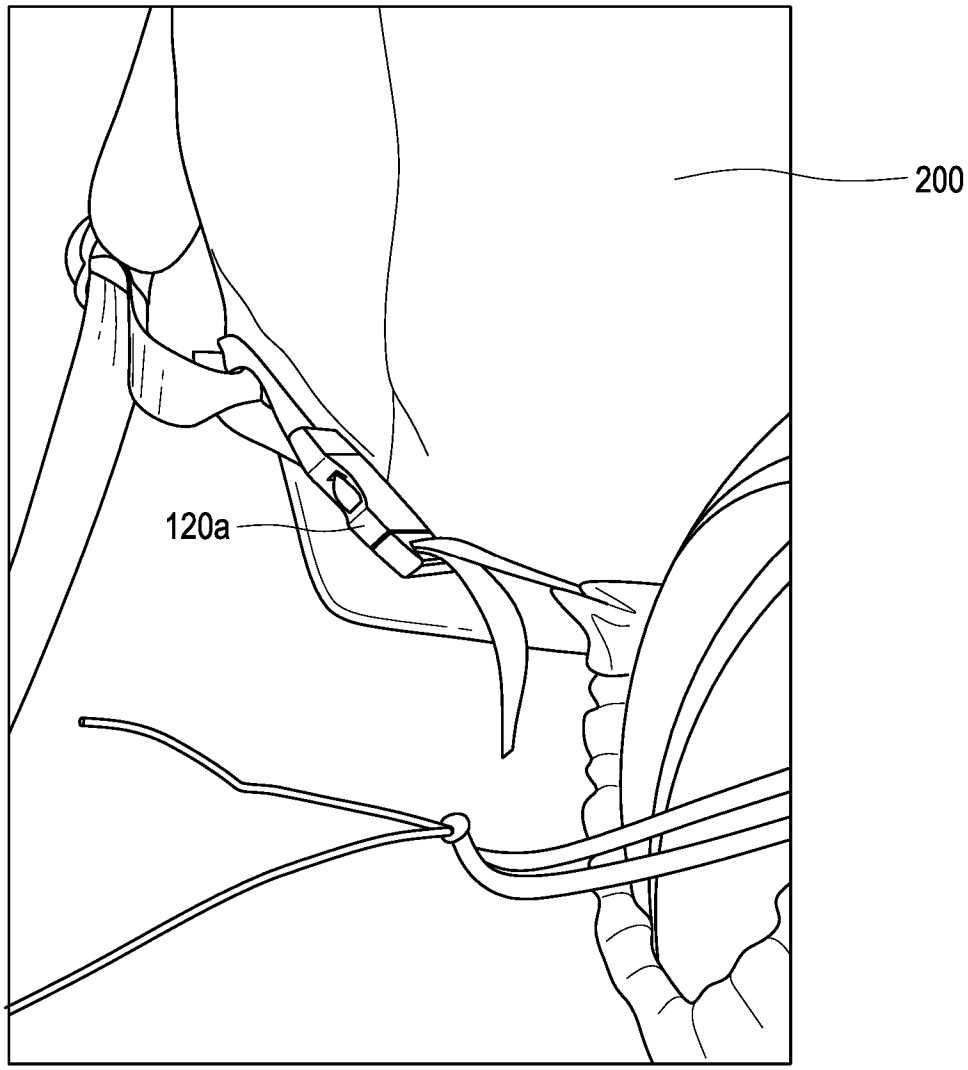
Figure 10:
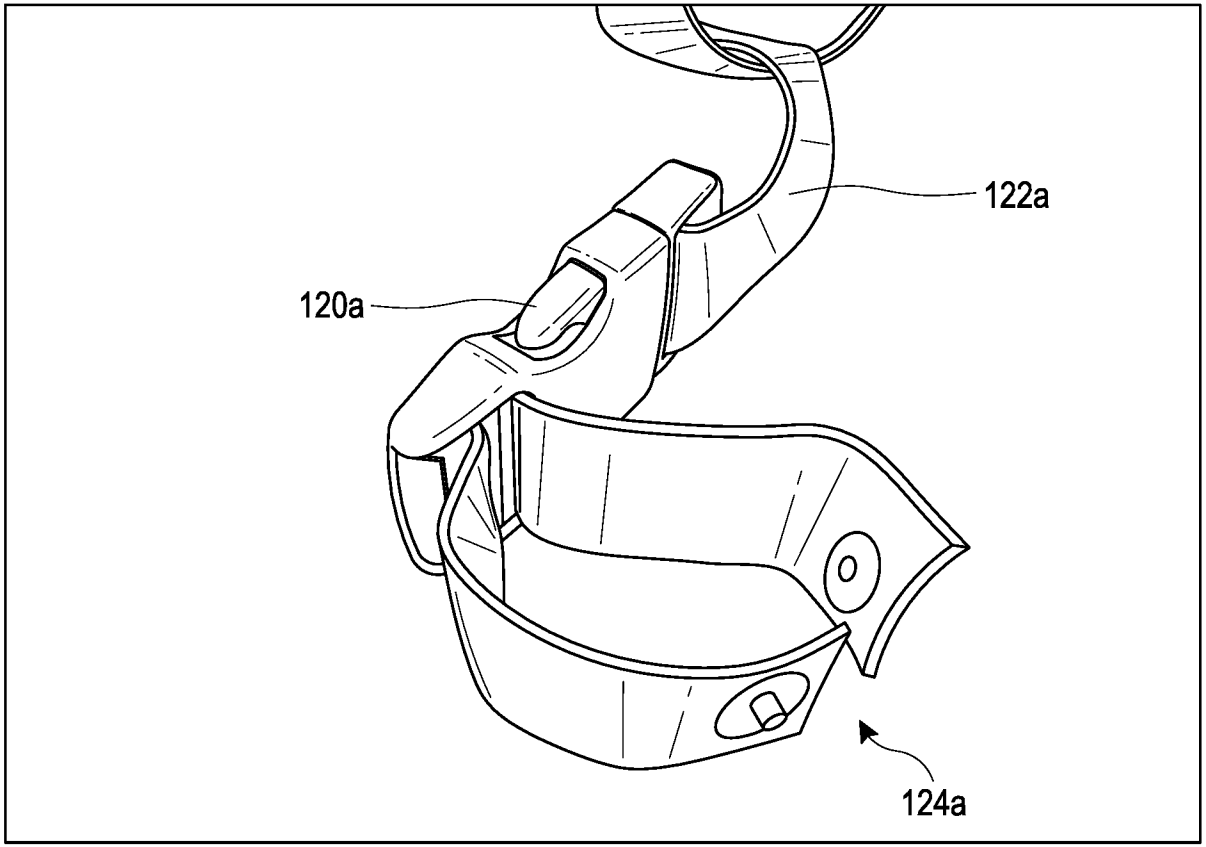

As shown in FIGS. 2, 4, and 6, the bag attachment assembly 100 can include a fastener 116. The fastener 116 can be located at a top portion of the panel 105. As described in previous paragraphs, in some embodiments, the panel 105 can comprise a perimeter portion 106 with a channel that can contain an elastic cord 102. The elastic cord 102 can extend throughout the perimeter portion 106 and through an opening in the perimeter portion 106 that can be located near the plurality of upper straps 112*a*, 112*b*. The fastener 116 can comprise, for example, a single or double barrel cord lock (also called a cord stop or cord toggle) that can receive the elastic cord 102. The fastener 116 can be biased to secure (e.g., pinch or lock) the cord. In some embodiments, the securement can be released by depressing a button.

When a user pushes the button on the fastener 116, engagement of the cord 102 is released. This can enable the user to pull either or both ends of the elastic cord 102, which in turn tightens the perimeter portion 106 around the ball, or other object, within the bag attachment accessory 100. After the user has tightened the perimeter portion 106 the desired amount, the user can release the button on the fastener 116 and the fastener 116 can secure to the cord 102 again, and thereby maintain the position of the elastic cord 102. In some variants, the user can use the fastener 116 to loosen the perimeter portion 106 and access the contents of the bag attachment assembly 100, e.g., a ball, without having to remove the bag attachment assembly 100 from the bag.

As mentioned above, the bag attachment assembly 100 can comprise the panel 105 and perimeter portion 106. The panel 105 can comprise a generally rectangular shape, though other shapes are contemplated as well (e.g., generally oval). In some aspects, a height of the panel 105 can be approximately 24 inches. In some aspects, the panel 105 can have a height of about 12 inches to about 24 inches, or about 14 inches to about 22 inches, or about 16 inches to about 22 inches, or about 18 inches to about 20 inches. In some aspects, the width of the panel 105 can be approximately 18 inches. In some aspects, the panel 105 can have a width of about 8 inches to about 18 inches, about 10 inches to about 16 inches, or about 12 inches to about 14 inches. In some embodiments, the panel 105 can comprise other shapes suitable for carrying objects outside a backpack 200 or other bag.

In some embodiments, the center portion 104 of the panel 105 can comprise an elastic material. The center portion 104 can comprise a plurality of vents (e.g., through holes), which can promote airflow. In some embodiments, the center portion 104 can comprise a first side and a second side. After the bag attachment accessory is attached to the backpack 200 or other bag, the first side of the center portion 104 (e.g., an interior side) can be facing the backpack 200 or other bag and the second side of the center portion 104 (e.g., an exterior side) can be facing away from the backpack 200 or other bag. In use, the first side of the center portion 104 can contact the ball or other bulky object.

In some embodiments, the perimeter portion 106 can be sewn to, or otherwise connected to, the perimeter of the center portion 104. As previously described, the perimeter portion 106 can be sewn around, or otherwise secured around, an elastic cord 102. The perimeter portion 106 can be configured to tighten around the ball or other object(s) when the elastic cord 102 is cinched, such as by being pulled through the opening. In some embodiments, the perimeter portion 106 can be connected to the plurality of upper straps 112*a*, 112*b* by the at least one upper attachment mechanism 110*a*, 110*b* (e.g., the upper squeeze clips). In some embodiments, the perimeter portion 106 can be connected to the plurality of lower straps 122*a*, 122*b* by the at least one lower attachment mechanism 122*a*, 122*b* (e.g., lower squeeze clips, as discussed below).

FIGS. 7-10 show portions of the bottom portion 118 of the bag attachment assembly 100. As described in previous paragraphs, the bottom portion 118 can comprise at least one bottom attachment mechanism and a plurality of bottom straps 122*a*, 122*b*. In some embodiments, the plurality of bottom straps 122*a*, 122*b* can comprise a first bottom strap 122*a* and a second bottom strap 122*b*. The first and second bottom straps 122*a*, 122*b* can comprise a flexible material, such as nylon. In some embodiments, one or both or the first and second bottom straps 122*a*, 122*b* include a connector 124*a*, 124*b*, such as a snap or button. For example, in some variants, one or each of the straps 122*a*, 122*b* comprises first and second legs, each with a free end. The free ends can include the connector. For example, one leg can include a male portion of the snap or button and the other leg can include a female portion of the snap or button.

In some aspects, the first and second bottom straps 122*a*, 122*b* can be configured to connect to (e.g., wrap around) a bottom portion of corresponding shoulder straps of the backpack 200. The bottom straps 122*a*, 122*b* can also or alternatively attach to other parts of the backpack 200 or to portions of other bags. In use, the bottom straps 122*a*, 122*b* can apply a compressive force between the panel 105 and the backpack 200 such that the ball or other object is secured between the panel 105 and the backpack 200. In some embodiments, the connector 124*a*, 124*b* can be configured to secure the bottom straps 122*a*, 122*b* around portions of the bag. A portion of each bottom strap 122*a*, 122*b* can comprise a protruding element of the connector 124*a*, 124*b* and a second portion of each strap 122*a*, 122*b* can comprise a receiving element of the connector 124*a*, 124*b*. In some embodiments, the bottom straps 122*a*, 122*b* can comprise a hook and loop fastener or any other fastening element suitable for securing the bottom straps 122*a*, 122*b* to the bag. In some embodiments, the connectors 124*a*, 124*b* can be disengaged (e.g., the male and female portions of the snaps or buttons separated) and the free ends of the legs can be positioned around the bottom portion of a backpack shoulder strap. The connectors 124*a*, 124*b* can then be engaged, thereby connecting the free ends and securing the relevant strap 122*a*, 122*b* to the backpack.

In some embodiments, the at least one bottom attachment mechanism can comprise a first lower squeeze clip 120*a* and a second lower squeeze clip 120*b*. The lower squeeze clips 120*a*, 120*b* can also be referred to as lower side release buckles. The lower squeeze clips 120*a*, 120*b* can be configured to attach a bottom portion of the panel 105 to the plurality of bottom straps 122*a*, 122*b*. In some embodiments, the lower squeeze clips 120*a*, 120*b* are larger than the upper squeeze clips 110*a*, 110*b*. In certain variants, the lower squeeze clips 120*a*, 120*b* are smaller than, or equal in size to, the upper squeeze clips 110*a*, 110*b*. In some aspects, the lower squeeze clips 120*a*, 120*b* may each comprise a male element and a female element. The female elements can be configured to receive the male elements. The male elements of the lower squeeze clips 120*a*, 120*b* may be attached to one of the plurality of bottom straps 122*a*, 122*b* or the bottom portion of the perimeter portion 106 of the panel 105. The female elements of the lower squeeze clips 120*a*, 120*b* may be attached to the other of the plurality of bottom straps 122*a*, 122*b* or the bottom portion of the perimeter portion 106 of the panel 105. Therefore, the bottom portion of the panel 105 may be attached to the bottom straps 122*a*, 122*b* by inserting the male elements into the female elements.

In some embodiments, the user can obtain multiple sets of upper and lower squeeze clips 110*a*, 110*b*, 120*a*, 120*b*. The multiple upper squeeze clips 110*a*, 110*b* and the lower squeeze clips 120*a*, 120*b* allow for the user to move the panel 105 to various bags without having to resize the straps, via the securing mechanisms (e.g., the hook and loop fastener 114*a*, 114*b* or the connector 124*a*, 124*b*), connected to the clips. For example, a user may have two sets of upper squeeze clips 110*a*, 110*b* and lower squeeze clips 120*a*, 120*b*. The user may attach the female elements of the first set of clips to a first bag and the female elements of the second set of clips to a second bag. The user may then move the panel 105 from the first bag to the second bag, for example, by removing the male elements from the female elements of the clips from the first bag and attaching the male elements to the female elements of the clips of the second bag. Thus, the user may move the panel 105 from bag to bag without removing the female elements of the clips from the bags.

The terms "first" and "second" are merely numbered for describing corresponding technical features clearly and do not represent the actual order. During particular implementations, the locations of the technical features defined by the terms "first" and "second" are interchangeable.

Terms of orientation used herein, such as "top," "bottom," "horizontal," "vertical," "longitudinal," "lateral," "outer," "inner," and "end" are used in the context of the illustrated embodiment. However, the present disclosure should not be limited to the illustrated orientation. Indeed, other orientations are possible and are within the scope of this disclosure. Terms relating to circular shapes as used herein, such as "diameter" or "radius," should be understood not to require perfect circular structures, but rather should be applied to any suitable structure with a cross-sectional region that can be measured from side-to-side. Terms relating to shapes generally, such as "circular" or "cylindrical" or "semi-circular" or "semi cylindrical" or any related or similar terms, are not required to conform strictly to the mathematical definitions of circles or cylinders or other structures, but can encompass structures that are reasonably close approximations.

The terms "approximately," "about" and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Conditional language, such as "can," "could," "might," or "may," unless specifically stated otherwise or otherwise understood within the context as used, is generally intended to convey that certain embodiments include or do not include, certain features, elements and/or steps. Thus, such conditional language is not generally intended to imply that features, elements and/or steps are in any way required for one or more embodiments.

Conjunctive language, such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y and at least one of Z.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed and/or rearranged. Further, the disclosure herein of any particular feature, aspect, method, property, characteristic, quality, attribute, element or the like in connection with various embodiments can be used in all other embodiments set forth herein. Additionally, any methods described herein may be practiced using any device suitable for performing the recited steps.

Although this invention has been disclosed in the context of certain embodiments and examples, the scope of this disclosure extends beyond the specifically disclosed embodiments to other alternative embodiments and/or uses of the invention and obvious modifications and equivalents thereof. Any system, method, and device described in this application can include any combination of the preceding features described in this and other paragraphs, among other features and combinations described herein, including features and combinations described in subsequent paragraphs. While several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with or substituted for, one another in order to form varying modes of the disclosed invention. Thus, it is intended that the scope of the present invention herein disclosed should not be limited by the particular disclosed embodiments described above, but should be determined only by a fair reading of the claims that follow.

The following is claimed:

1. A bag attachment assembly configured to removably connect to a backpack and to carry one or more balls outside of the backpack, the bag attachment assembly comprising:

a panel configured to at least partially surround a space configured to receive the one or more balls, the panel comprising:

a center portion comprising an elastic material, and a perimeter portion bounding and encompassing the center portion, the perimeter portion having a channel with an elastic cord, the elastic cord configured to be pulled at least partly out of the channel;

a cord lock connected to the elastic cord, wherein the cord lock is configured to secure the elastic cord in a position relative to the channel;

a plurality of upper straps configured to secure the panel to an upper portion of the backpack, wherein each of the plurality of upper straps comprise an upper adjustment mechanism and an upper connector, the upper adjustment mechanism configured to adjust a length of the respective upper strap and the upper connector configured to connect the respective upper strap to the upper portion of the backpack; and a plurality of lower straps configured to secure the panel to a lower portion of the backpack, wherein each of the plurality of lower straps comprise a lower adjustment mechanism and a lower connector, the lower adjustment mechanism configured to adjust a length of the respective lower strap and the lower connector configured to connect the respective lower strap to the lower portion of the backpack;

wherein the bag attachment assembly is configured such that, in response to the elastic cord being pulled partially out of the channel, the panel cinches around the one or more balls and applies a compressive force on the one or more balls against the backpack.

2. The bag attachment assembly of claim 1, wherein the upper adjustment mechanism comprises a squeeze clip and the upper connector comprises a hook and loop fastener.

3. The bag attachment assembly of claim 1, wherein the lower adjustment mechanism comprises a squeeze clip and the lower connector comprises a male and female snap assembly.

4. The bag attachment assembly of claim 1, wherein a height of the panel is approximately 24 inches and a width of the panel is approximately 18 inches.

5. The bag attachment assembly of claim 1, wherein the plurality of upper straps and the plurality of lower straps are configured to adjust the bag attachment assembly without removing the bag attachment assembly via the upper connector and/or the lower connector.

6. The bag attachment assembly of claim 1, wherein the cord lock is configured to allow the user to loosen the perimeter portion such that the user is able to access the one or more balls stored between the bag attachment assembly and the backpack without removing the bag attachment assembly from the backpack.

7. A bag attachment assembly configured to removably connect to a bag and to carry one or more objects outside of the bag, the bag attachment assembly comprising:

a body comprising:

an interior side configured to contact the one or more objects in use;

an exterior side configured to face away from the one or more objects in use;

a top side, a bottom side, a right side, and a left side; and a perimeter portion bounding at least the top side, bottom side, right side, and left side, the perimeter portion comprising an internal portion and an external portion, the internal portion comprising an internal passageway with an elastic cord, the external portion comprising an opening at a top of the perimeter portion, wherein an external portion of the elastic cord passes through the opening;

a top portion connected with the body, the top portion comprising:

an upper elongate strap configured to attach the bag attachment assembly to the bag, the upper elongate strap comprising a first portion and a second portion, wherein the first portion comprises a first element of a hook and loop fastener and the second portion comprises a second element of the hook and loop fastener; and an upper attachment mechanism configured to attach the top of the perimeter portion to the upper elongate strap;

a bottom portion connected with the body, the bottom portion comprising:

a bottom elongate strap, wherein a first portion of the bottom elongate strap comprises an element of a mating fastener and a second portion of the bottom elongate strap comprises a corresponding element of the mating fastener; and a bottom attachment mechanism, wherein the bottom attachment mechanism is configured to attach a portion of a bottom of the perimeter portion to the bottom elongate strap; and a fastener configured to engage with the external portion of the elastic cord of the body, wherein the bag attachment assembly is configured such that actuating the fastener allows a user to pull the external portion of the elastic cord and thereby tighten the perimeter portion around the one or more objects and compress the object against the bag.

8. The bag attachment assembly of claim 7, wherein the bag comprises a backpack.

9. The bag attachment assembly of claim 7, wherein the bag comprises a duffel bag.

10. The bag attachment assembly of claim 7, wherein the upper attachment mechanism comprises a first upper squeeze clip and a second upper squeeze clip.

11. The bag attachment assembly of claim 7, wherein the upper elongate strap and the bottom elongate strap comprise nylon material.

12. The bag attachment assembly of claim 7, wherein the upper attachment mechanism and the bottom attachment mechanism are configured to adjust the bag attachment assembly without removing the hook and loop fastener or the mating fastener.

13. The bag attachment assembly of claim 7, wherein the fastener is configured to allow the user to loosen the perimeter portion such that the user is able to access the one or more objects stored between the bag attachment assembly and the bag without removing the bag attachment assembly from the bag.

14. The bag attachment assembly of claim 7, wherein the one or more objects comprises a basketball.

15. The bag attachment assembly of claim 7, wherein the mating fastener comprises a snap fastener.

* * * * *